US008596096B1

(12) United States Patent
Russell et al.

(10) Patent No.: US 8,596,096 B1
(45) Date of Patent: Dec. 3, 2013

(54) KNITTING LOOM

(75) Inventors: Warren Russell, Murfreesboro, TN (US); David Sasur, Ludlow, MA (US); Kenneth Hatcher, Smyrna, TN (US)

(73) Assignee: Simplicity Pattern Co., Inc., Antioch, TN (US)

( * ) Notice: Subject to any disclaimer, the term of this patent is extended or adjusted under 35 U.S.C. 154(b) by 20 days.

(21) Appl. No.: 13/553,581

(22) Filed: Jul. 19, 2012

(51) Int. Cl.
*D04B 3/00* (2006.01)

(52) U.S. Cl.
USPC ..... 66/4

(58) Field of Classification Search
USPC ..... 66/1 R, 1 A, 3, 4
See application file for complete search history.

(56) References Cited

U.S. PATENT DOCUMENTS

| | | | | | |
|---|---|---|---|---|---|
| 1,318,604 | A | * | 10/1919 | Schneider | 66/4 |
| 1,500,383 | A | * | 7/1924 | Gourie | 66/4 |
| 1,694,849 | A | * | 12/1928 | Fujii | 66/4 |
| 1,705,860 | A | * | 3/1929 | Hagihara | 66/4 |
| 2,072,668 | A | | 7/1936 | Eltgroth | |
| 3,967,467 | A | | 7/1976 | Leach, Sr. | |
| 4,193,273 | A | * | 3/1980 | Palange | 66/4 |
| 4,246,768 | A | * | 1/1981 | Palange | 66/4 |
| 4,248,063 | A | | 2/1981 | Wang | |
| 4,393,668 | A | | 7/1983 | Leach, Sr. | |
| 4,729,229 | A | * | 3/1988 | Whicker | 66/4 |
| 5,125,245 | A | | 6/1992 | Kuwabara | |
| 5,231,742 | A | * | 8/1993 | Macbain | 28/151 |
| 5,413,150 | A | * | 5/1995 | Townsend | 139/34 |
| 5,542,268 | A | * | 8/1996 | Palange | 66/1 R |
| 5,577,400 | A | * | 11/1996 | Palange | 66/4 |
| 6,810,697 | B2 | * | 11/2004 | Sangiacomo | 66/148 |
| 7,506,524 | B2 | | 3/2009 | Gustin | |
| 7,578,146 | B2 | | 8/2009 | Gustin | |
| 2008/0156043 | A1 | * | 7/2008 | Gustin | 66/4 |
| 2008/0223083 | A1 | * | 9/2008 | Gustin | 66/1 A |
| 2012/0047960 | A1 | * | 3/2012 | Sasur | 66/1 A |

* cited by examiner

*Primary Examiner* — Danny Worrell
(74) *Attorney, Agent, or Firm* — Pillsbury Winthrop Shaw Pittman, LLP

(57) ABSTRACT

A knitting loom that includes a base structure with pin receiving openings for receiving knitting pegs. Each opening has a through hole that allows access to a bottom portion of a knitting peg inserted therein. The knitting peg is adapted to hinder its removal from the pin receiving opening and base structure via a detent or lock provided adjacent its bottom portion. A slot can be provided in the bottom of the loom, which assists in removal of a broken peg from within an opening and allows the loom to be reusable.

14 Claims, 8 Drawing Sheets

KNITTING LOOM

BACKGROUND

Knitting looms with a plurality of knitting pegs extending upwardly from the base and having a solid base structure are generally known, as illustrated by U.S. Pat. No. 7,506,524. However, if a knitting peg breaks off in its receiving opening in a conventional loom, it can be difficult to remove the broken portion of the knitting peg from the loom, potentially forcing a user to replace the loom. Further, knitting pegs may easily fall out of conventional looms.

SUMMARY

One aspect of the disclosure provides a knitting loom including: a base structure with a plurality of pin receiving openings, each pin receiving opening having a through hole with a shape configured to receive a knitting peg therein. The knitting loom also has a plurality of knitting pegs received in the openings, each knitting peg having a body having a shape complimentary to the shape of the pin receiving openings. Knitting pegs are positioned within the pin receiving openings such that the knitting pegs extend perpendicularly away from the base structure. The knitting pegs also have a bottom portion that is accessible through a bottom of the base structure such that a user can eject the knitting peg from its pin receiving opening.

Another aspect of the disclosure provides a knitting loom having a base structure with a plurality of pin receiving openings, each pin receiving opening having a shape configured to receive a knitting peg therein. The knitting loom also includes a plurality of knitting pegs received in the pin receiving openings, each knitting peg having a body having a shape complimentary to the shape of the pin receiving openings. Knitting pegs are positioned within the pin receiving openings such that the knitting pegs extend perpendicularly away from the base structure. Each knitting peg also has a body with a detent adjacent a bottom portion of the body, the detent configured to hold its respective knitting peg within the pin receiving opening.

Other features and advantages of the present disclosure will become apparent from the following detailed description, the accompanying drawings, and the appended claims.

DETAILED DESCRIPTION

Between the figures and the description herebelow, there is shown and described hand held knitting looms for knitting garments and other items using yarn or other material. As referenced herein, "yarn" refers to a flexible material suitable for weaving, such as commercially available twines and yarn.

Figure 1:
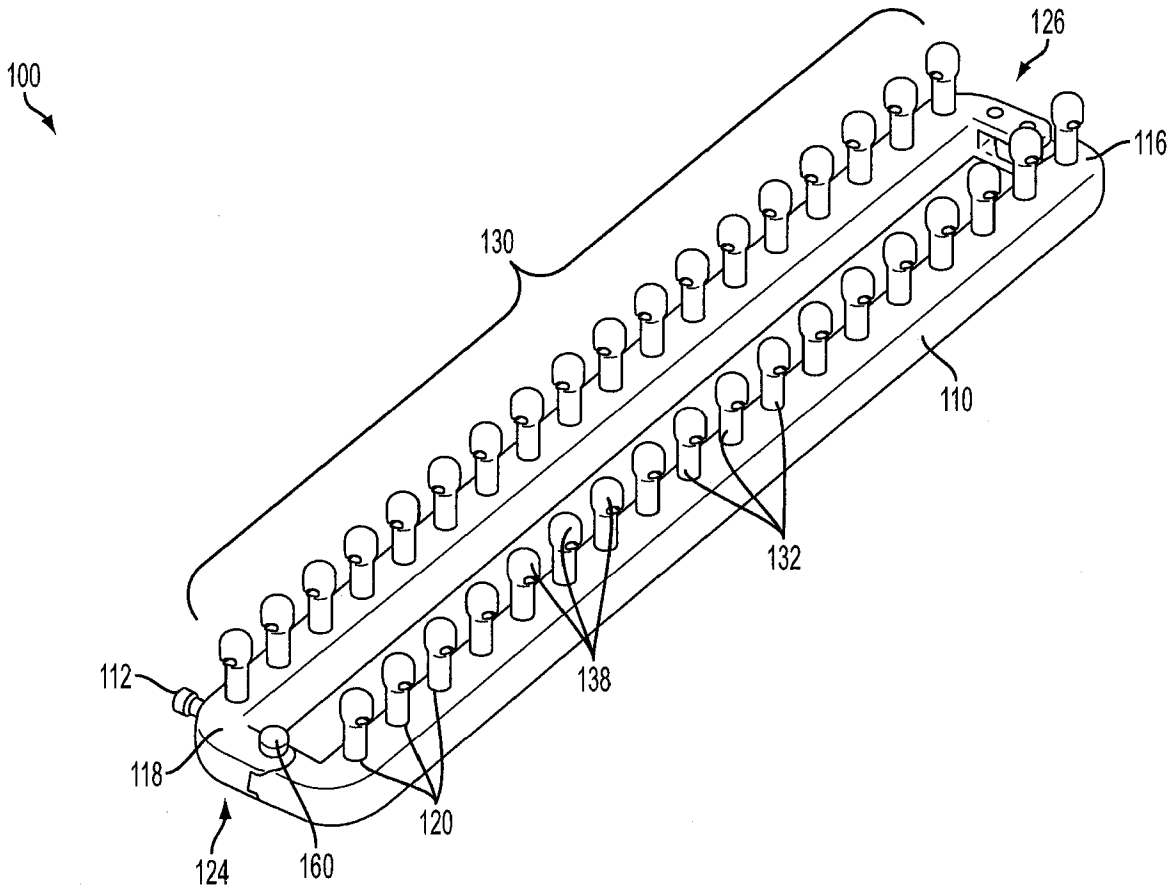
FIGS. 1-2 illustrate perspective and bottom views, respectively, of a knitting loom in accordance with an embodiment.
Figure 2:
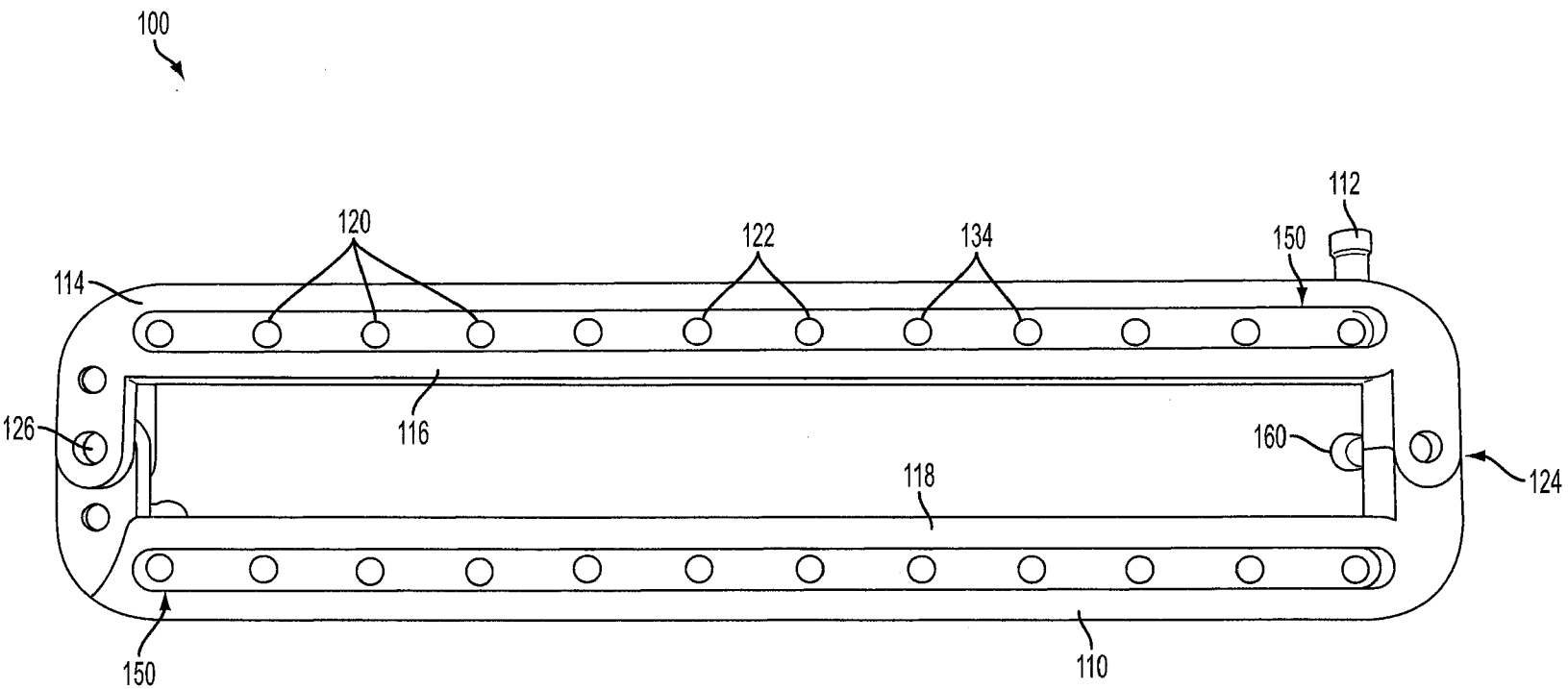

FIGS. 1-2 illustrate an example of a knitting loom 100. In this illustrated embodiment, the knitting loom 100 comprises a base structure 110. Base structure 110 has a plurality of pin receiving openings 120, each configured to receive a knitting peg 130 therein. Different base structures 110 may have differing numbers of pin receiving openings 120. Knitting loom 100, for example, has thirty-six pin receiving openings 120 and at least corresponding knitting pegs 130 in accordance with one embodiment. However, it should be understood that various sizes and shapes of base structures and various numbers of openings 120 and pegs 130 may be used with a loom and thus any number of each remains within the scope of this disclosure and is not limited to the illustrated embodiment. More or less than thirty-six pin receiving openings and pegs may be provided.

In this embodiment, base structure 110 is illustrated as having two substantially parallel parts 116 and 118. This can facilitate a base structure 110 where the two parallel parts 116 and 118 are able to connect and detach from one another via removable fasteners being inserted into their ends (e.g., ends may overlap or intersect). In another embodiment, base structure 110 can have two parallel parts 116 and 118 that are connected via a hinge at one end 126 of the base structure and have a removable connection via a removable fastener 160 at an opposed end 124, such as disclosed in U.S. Ser. No. 13/217,503, filed Aug. 25, 2011 and Published as 2012/0047960 A1, assigned to the same assignee, which is hereby incorporated by reference in its entirety.

The base structure 110 of FIGS. 1 and 2 also includes at least one yarn attachment point 112, which may be in the form of an end peg, located on at least one end of the base structure 110. Yarn attachment point 112 may be used to hold an end of a piece of yarn in place when initiating knitting.

Each pin receiving opening 120 comprises a through hole 122. The through hole 122 has a shape configured to receive a knitting peg therein (e.g., which are shown in greater detail in FIG. 6). Further, the pin receiving openings 120 can be spaced substantially equidistant relative to one another around base structure 110 (so that the knitting pegs 130 may be spaced equidistant relative to each other). "Substantially equidistant" refers to any two adjacent pin receiving openings 120 that are spaced apart by a substantially equal distance (on either or both sides). The openings 120 are configured to hold the pegs 130 received therein tightly in place. Accordingly, each of the parallel parts 116 and 118 extends in a longitudinal direction and has a plurality of knitting pegs 130 provided between its respective ends. As understood in the art, when the knitting loom 100 is configured and ready for use, a user can wrap yarn about knitting pegs 130 in a variety of directions and patterns to knit a desired item. In an embodiment, the knitting pegs 130 may be removable. A user may remove or insert knitting pegs 130 into pin receiving openings 120 in various configurations to adjust the number and relative positions of knitting pegs 130 in the base structure 110. This may affect the length or shape of an item being knit, for example. In an embodiment, such as described further below, knitting pegs 130 are at least temporarily locked within base structure 110.

Each knitting peg 130 comprises a body 132, a bottom portion 134, and a head 138. The body 132 has a shape that compliments the shape of the pin receiving openings 120. For example, as explained in further detail below, in an embodiment, the body 132 of knitting pegs 130 and through hole 122 of the pin receiving openings 120 may taper so that the knitting pegs 130 snugly fit inside the pin receiving openings 120. In one embodiment, each through hole 122 may taper between approximately one to approximately two degrees from a top surface of the loom to about a midpoint. For example, the through hole 122 may taper at an angle from a top surface of the base structure 110 a point where through hole 122 and a slot 150 (described below) intersect or meet. In another embodiment, through hole 122 may also include a guide (not shown). The guide may be, for example, a protrusion formed within the through hole 122 that ensures that a knitting peg 130 is properly aligned when inserted into the pin receiving opening 120 (e.g., by aligning groove 326 in through hole 122, described later with reference to FIGS. 5 and 6). However, the shape and configuration of each through hole 122 is not meant to be limited. Additional configurations that are complimentary to a shape of a portion of a knitting peg, or vice versa, that allow at least for temporary holding or locking of the peg therein are considered to be within the scope of this disclosure.

The knitting pegs 130 are positioned within the pin receiving openings 120 such that the knitting pegs 130 extend perpendicularly away from the base structure 110. Bottom portion 134 is accessible through a bottom 114 of the base structure 110. For example, a user can eject a knitting peg 130 from its pin receiving opening 120 by pushing on its bottom portion 134 with a finger, a tool 170, and so forth. The tool may be, for example, a crochet needle or a yarn hook (e.g., yarn hook 400, see FIG. 8), that is used with the loom 100 during the knitting process.

In one example, base structure 110 also comprises a slot 150. The slot may be defined by the bottom 114 of the base structure 110. The slot 150 may connect at least two adjacent pin receiving openings 120. For example, slot 150 runs along the bottoms of each of the parts 116 and 118 substantially between each of their respective ends thereof, each part 116 and 118 having its own separate slot 150. FIG. 2 shows slots 150 in bottom 114 of base structure 110 in greater detail.

Figure 3:
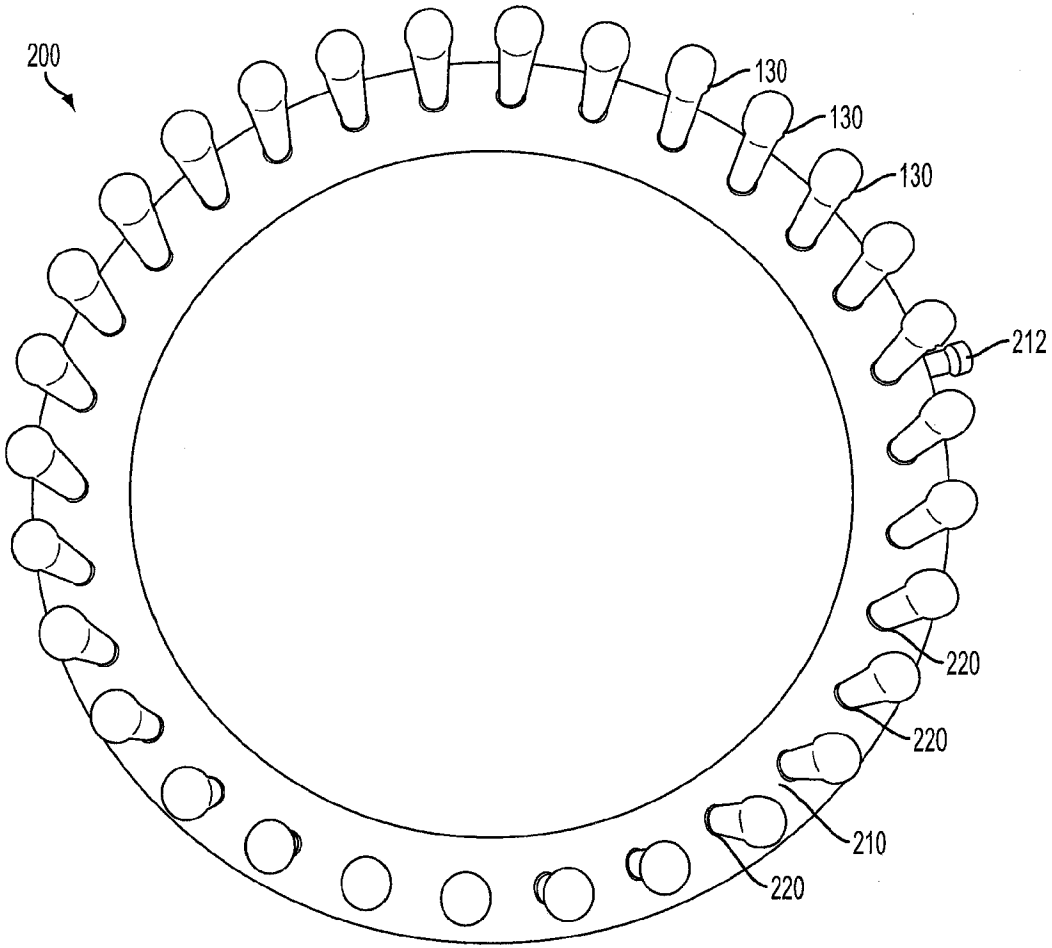
FIGS. 3-5 illustrate top and bottom perspective views of a knitting loom in accordance with another embodiment.
Figure 4:
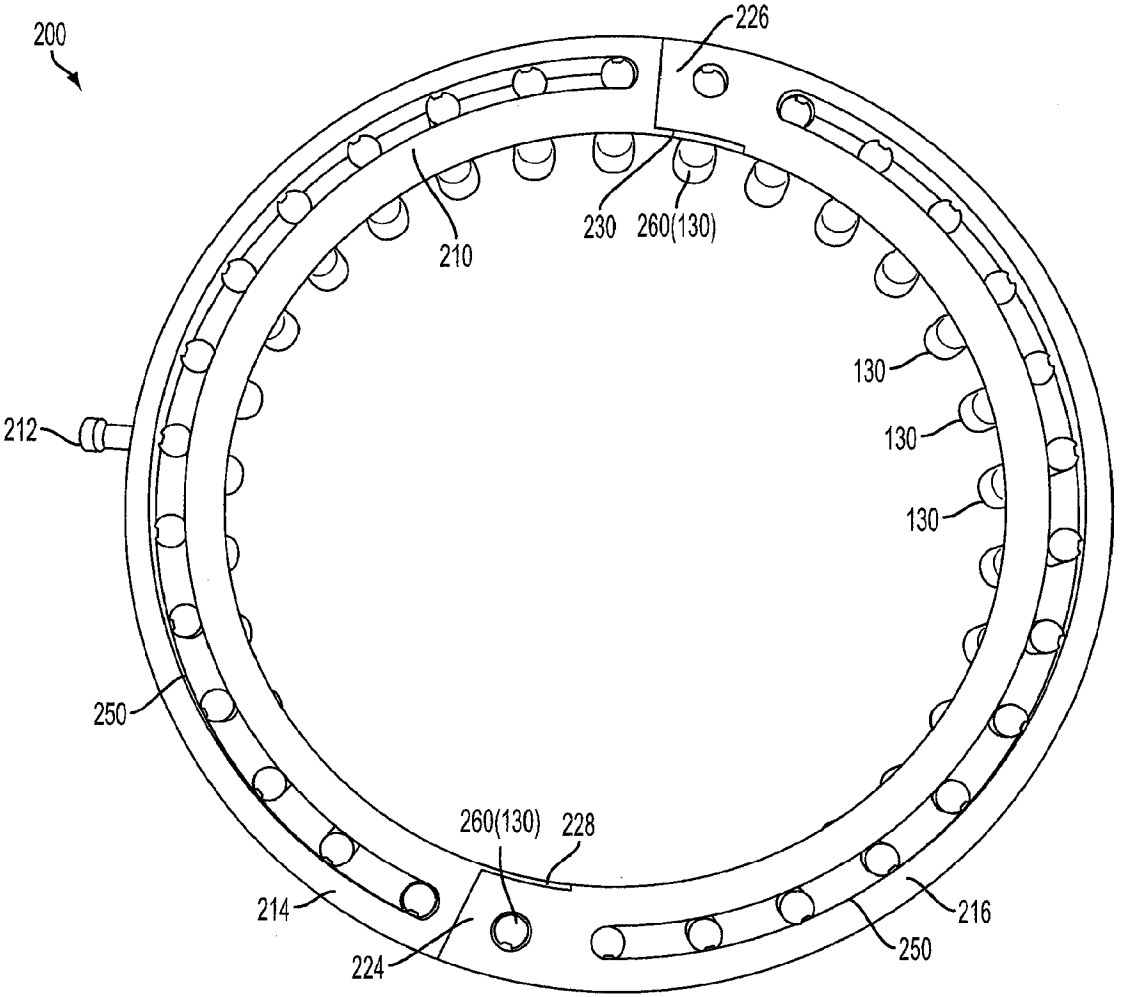
Figure 5:
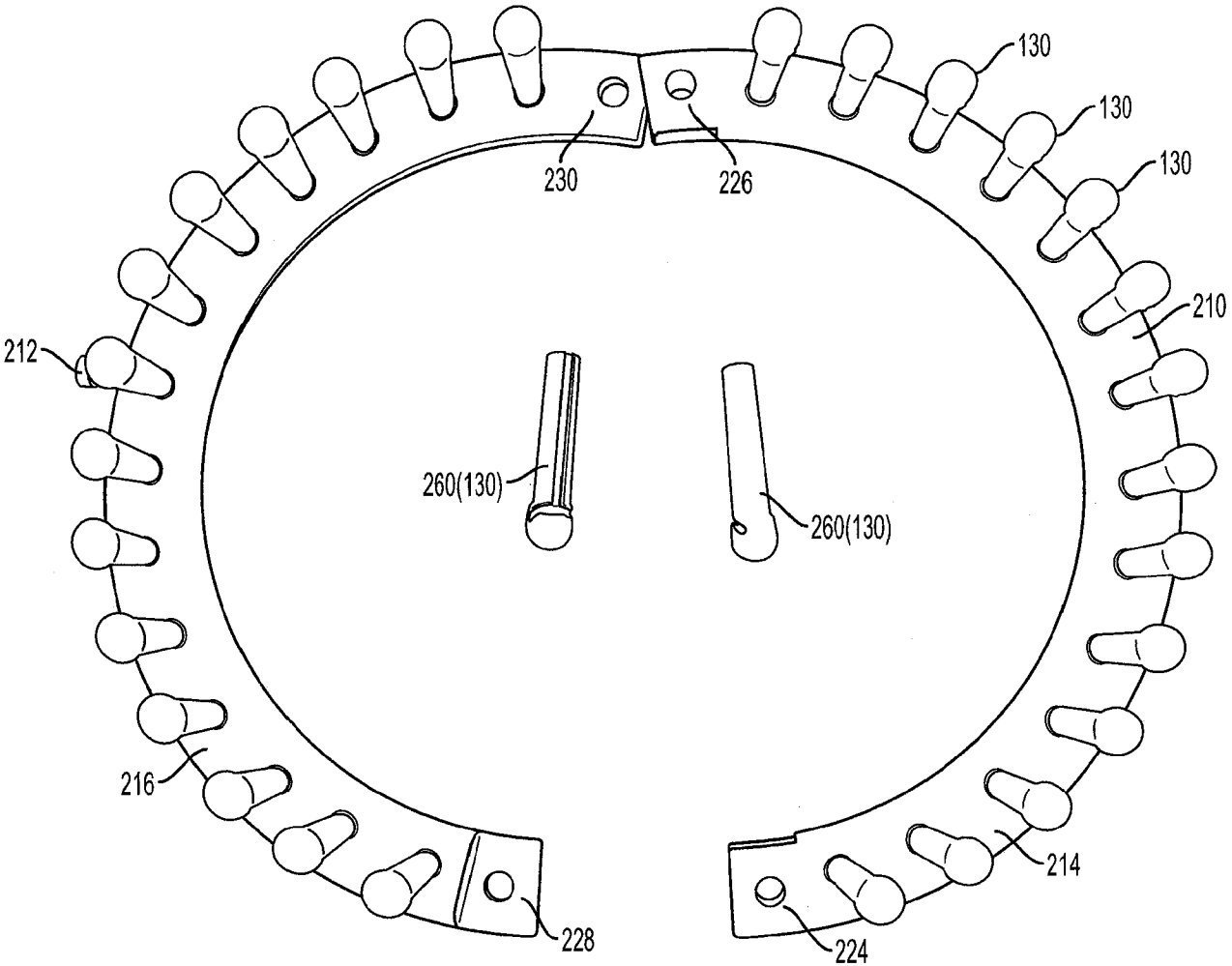

Alternative base structures 110 are also possible. For example, FIGS. 3-5 illustrate perspective views of an example knitting loom 200 having a substantially circular base structure 210. Base structure 210 also includes at least one yarn attachment point 212, which may be in the form of an end peg, located on a circumference of base structure 210. Base structure 210 has a plurality of pin receiving openings 220, each configured to receive a knitting peg, like knitting pegs 130, therein. Any number of pin receiving openings 220 may be provided. In an embodiment, knitting loom 200 has a total of thirty pin receiving openings 220 with at least corresponding knitting pegs 130 when assembled for use. However, as noted above, it should be understood that various sizes and shapes of base structures and various numbers of openings 220 and pegs 130 may be used with a loom and thus any number remains within the scope of this disclosure and is not limited to the illustrated embodiment. More or less than thirty pin receiving openings and pegs may be provided.

Like knitting loom 100 described above, each pin receiving opening 220 of base structure 210 comprises a through hole. The through hole has a shape configured to receive a knitting peg therein (e.g., which are shown in detail in FIG. 6). Further, the pin receiving openings 220 can be spaced substantially equidistant relative to one another around base structure 210 (so that the knitting pegs 130 may be spaced equidistant relative to each other). The openings 220 are configured to hold the pegs 130 received therein tightly in place.

In an embodiment, shown in greater detail in FIG. 5, the circular base structure 210 may be divided into two substantially semi-circular portions 214 and 216 that detach from one another via removable fasteners 260. For example, a first portion 214 can have ends 224 and 226 each with an opening therein and a second portion 216 can have ends 228 and 230 each with an opening therein. The ends 224-230 of each of the semi-circular portions 214 and 216 can be formed or shaped such that they overlap or intersect and can be connected to form the base structure 210. That is, openings on the ends 224 and 228 can be aligned and openings on ends 226 and 230 can be aligned such that the portions 214 and 216 substantially form the circular base structure 210. Removable fasteners 260 can be inserted through the aligned openings at both aligned ends 224 and 228 and 226 and 230 of the portions 214 and 216. In one embodiment, knitting pegs (such as pegs 130) act as the removable fasteners for securing the portions 214 and 216 together. By using knitting pegs 130 as fasteners, they will not only hold the portions 214 and 216 together but also provide a knitting peg for use during knitting which is spaced relative to the other knitting pegs 130 in the openings 220.

A slot 250 may be defined by a bottom 218 of the base structure 210. The slot 250 may connect at least two adjacent pin receiving openings 220. In an embodiment, the slot 250 may run substantially entirely along the entire bottom of the base structure 210. In the case wherein detachable portions 214 and 216 are used, such as shown in FIGS. 4 and 5, each semi-circular length 214 may have its own slot 250. For example, as can be seen in FIG. 4, each portion 214 and 216 has a slot 250 that extends substantially between its ends 224-226 and 228-230. The slots 250 extend along the bottom to connect the openings 220 between the adjacent the aligned openings, but not the ends 224, 226, 228, and 230 themselves. This may improve structural integrity of the base structure 210 and/or provide space for the removable fastener 260. However, this depiction of the slot, including the positioning and number of connecting pin receiving openings, is not meant to be limiting. For example, it may be preferable for the slots 250 not to extend the entire semi-circular length.

A person having ordinary skill in the art will recognize other potential shapes of base structures, besides those illustrated in FIGS. 1-5, may be appropriate or desirable. The base structure 110, knitting pegs 130 and other parts of the knitting loom 100 may be of any desirable size and may contain any number spaces for knitting pegs 130. In addition, the knitting loom 100 may be made of any suitable material, such as wood, plastic, rubber, or metal.

When using either of the knitting looms 100 or 200 disclosed herein, one of ordinary skill in the art would attach yarn to one of the knitting pegs 130 or the yarn attachment point 112 or 212 by knotting, for example. The yarn is then wrapped around the knitting pegs 130 using the desired method (e.g., slipped stitch method, selvedge method, flat panel knitting, double knit, etc.), and the loops are moved and woven until the desired amount or length of knitting by the user is achieved. For example, each peg can be wrapped with yarn, and then wrapped a second time. A small tool, like tool 400, is used to lift a lower loop of yarn over the upper (top) loop of yarn, over a head 138 of a knitting peg 130, to anchor each stitch. The head 138 of the pegs 130 keeps the yarn from slipping off of the pegs and at the same time minimizes the amount of stretching required to remove the loop. To remove the knitted item, any removable fasteners 160 or 260 can be removed from their respective parts, allowing the knitted item to be more easily removed from the plurality of pegs 130, and then secured as desired.

Accordingly, despite their shape, the inclusion of one or more slots 150 and 250 on the bottoms of the base structures 110 and 210 allows the loom to be reusable if any pegs break within their respective pin receiving openings. Therefore, examples disclosed in reference to the looms in FIGS. 1-5 may allow a user to clear out pieces of broken knitting pegs. As described above, a broken knitting peg may have rendered previous knitting looms completely or partially inoperative, forcing a user to replace the knitting loom. For example, a broken peg can remain stuck within an opening, which can render a portion of the loom unusable. Slots 150 or 250 allow for access to either or both a bottom and top portion of a knitting peg. A user can simply push a broken peg out with the tool 400 (e.g., using its hook), e.g., through a bottom of the through hole 122, for example, and replace the knitting peg. Further, access to the bottom of the knitting peg (e.g., through the slot) may provide users of the knitting loom a manner of removing knitting pegs from the knitting loom that is less likely to cause the knitting peg to break in the loom to begin with (e.g., by pushing the knitting peg from the bottom as opposed to pulling the knitting peg from the top).

Figure 7:
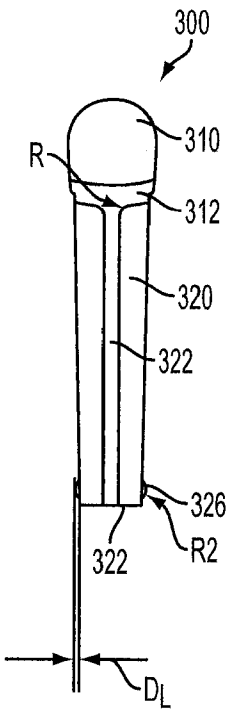
FIGS. 6-8 illustrate alternate side and front views of a knitting peg in accordance with an embodiment.
Figure 6:
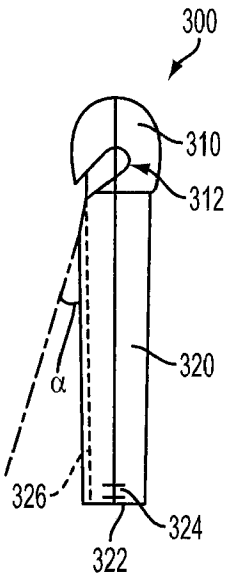
Figure 8:
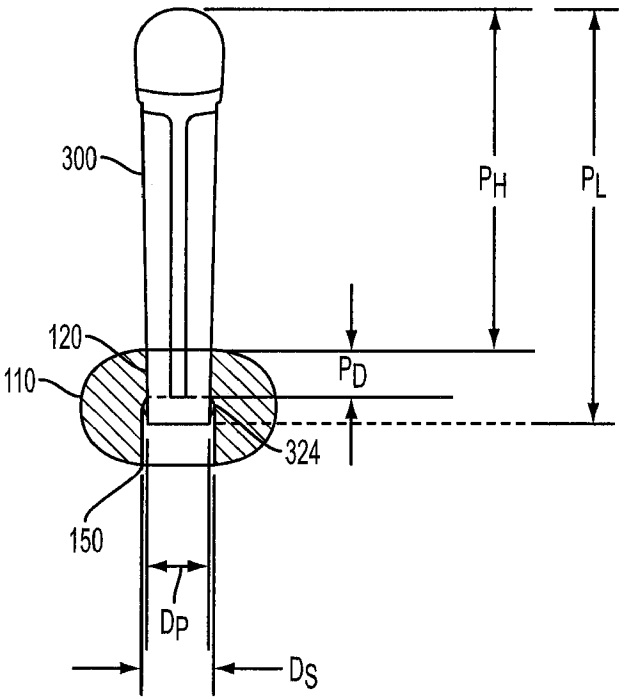
Figure 9:
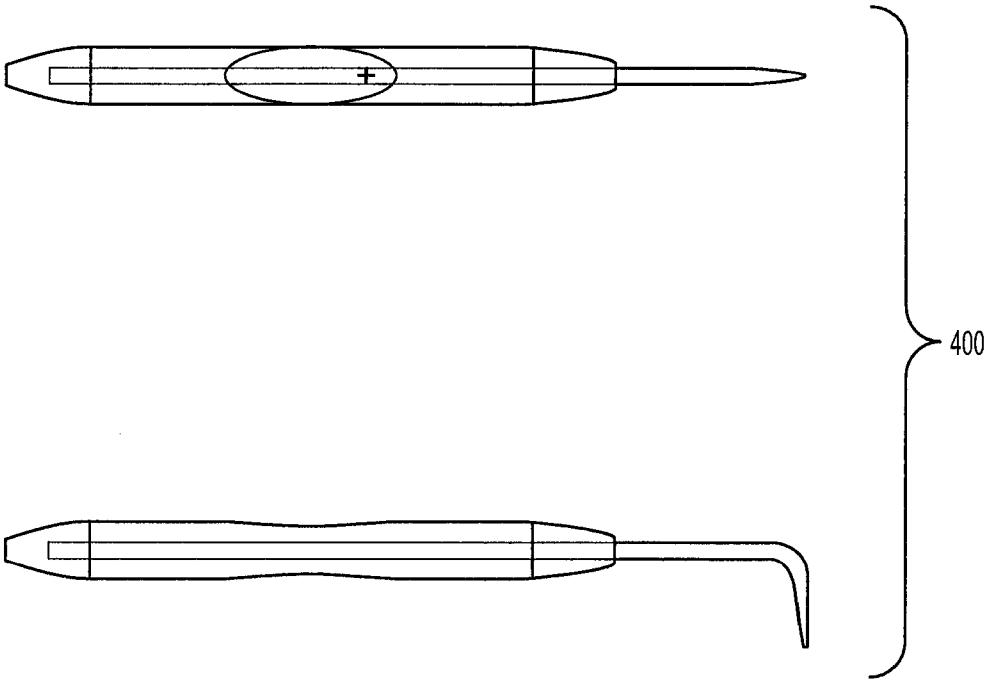
FIG. 9 illustrates top and perspective views, respectively, of a tool with a hook in accordance with an embodiment.

FIGS. 6-8 illustrate perspective views of an example knitting peg 300, in accordance with an embodiment herein, which is a detail of the knitting pegs 130 that can be used in the looms 100 and 200 described above. Knitting peg 300 includes a head 310, a body 320, and a bottom portion 322. The head 310 may have a portion that is wider than a portion of the body 320. This may deter yarn wrapped around knitting peg 300 from unintentionally slipping over the head 310 of the knitting peg 300. The head 310 may also include a notch 312 to catch yarn slipping upwards along the knitting peg 300.

The body 320 may include a groove 326. Groove 326 may facilitate aligning the knitting peg 300 when it is placed into a pin receiving opening, such as described above with respect to pin receiving opening 120. For example, a guide (not shown) of through hole 122 may be used for alignment with groove 326 of the peg 300 to ensure that the knitting peg 300 is properly aligned when inserted into the pin receiving opening. Groove 326 may also allow for a user to use a hook of a tool such as yarn hook 400 to reach under a piece of yarn when a user seeks to remove and/or move the yarn relative to the knitting peg 300. The surfaces of the groove may be rounded so that sharp edges along the pin are removed. For example, as shown in FIG. 6, a front edge below the head 310 may be formed at an angle $\alpha$ relative to the groove 326 so that yarn can easily slide into the notch 312 under the head. In one embodiment, the angle $\alpha$ is between and/or including approximately ten degrees to approximately fifteen degrees. In another embodiment, the angle $\alpha$ is approximately twelve degrees. Also, as another example, as shown in FIG. 7, as the groove 326 curves downwardly (from either side) from the head 310 towards the bottom 322 along the length of the body 320, the edges may be formed with a radius R. Although only shown on a first (right) side, both sides can be formed with a radius R. In an embodiment, the edge has a radius R of approximately 0.040.

Knitting peg 300 also includes a detent 324. Detent 324 is adjacent a bottom portion 322 of body 320. As used herein, the term adjacent is intended to describe that detent 324 is at or near a bottom portion 322 of body 320 of knitting peg 300. Detent 324 may be configured to hold knitting peg 300 within a pin receiving opening on a base structure (e.g., pin receiving opening 120 on base structure 110). In one example, knitting peg 300 may snap fit into a pin receiving opening via detent 324. Detent 324 can hold its respective knitting peg 300 within pin receiving opening 120 (or through hole 122) via passage through pin receiving opening 120 and into slot 150. Any portion of base structure 100 may be adapted to receive or lock with detent 324. A detent 324 may be designed to substantially and/or completely prevent removal of a knitting peg 300 without snapping the knitting peg 300. In another embodiment, the detent 324 would simply deter removal of the knitting peg 300 while still allowing the knitting peg 300 to be removable.

Figure 10:
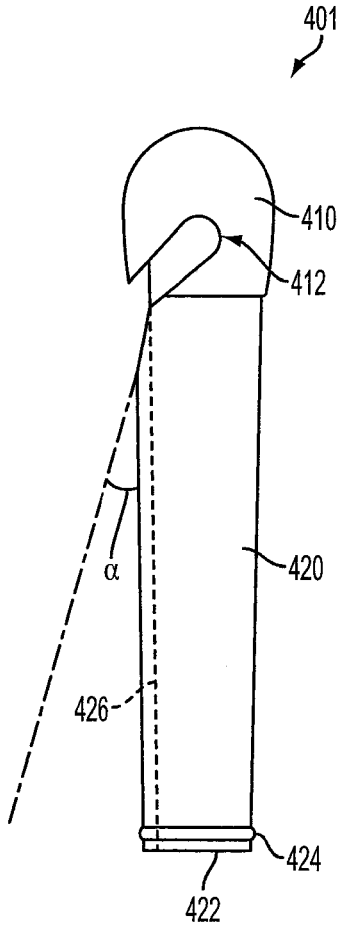
FIGS. 10 and 11 illustrate alternate side and front views of a knitting peg in accordance with another embodiment.
Figure 11:
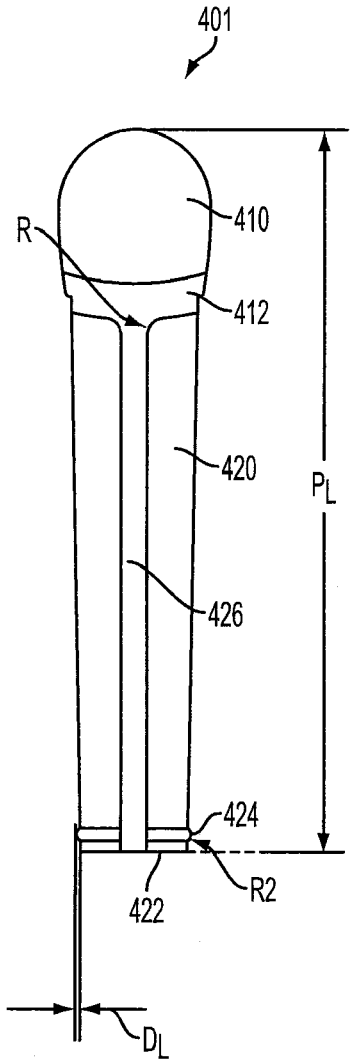

A person having ordinary skill in the art will recognize that many different types of detents 324 are possible. In one example, the detent 324 may be a bulge, a protrusion, or a bulbous portion. FIGS. 10 and 11, described further below, illustrate alternate side and front views of a knitting peg 401 in accordance with another embodiment having a locking detent 424 that extends substantially around the circumference of a its body 420 at or adjacent its bottom. The detent or a protrusion may, for example, extend a distance $D_L$ from an edge of the body 320 of the knitting peg 300 (see FIG. 7). In an embodiment, the detent 324 is a substantially rounded extension comprising a radius R2 (see FIG. 7). The radius of the detent may be approximately 0.030, for example. In another example, the protrusion may extend from the entire circumference of the body 320 of the knitting peg 300 except for where the groove 326 is located. In yet another example, the protrusion may only extend from a portion or portions of the body 320 of the knitting peg 300. That is, multiple protrusions may be provided on the body 320.

Additionally, instead of a protrusion, in accordance with another embodiment, detent 324 may be provided in the form of one or more indentations on the body 320 of the knitting peg 300 (with through hole 122 having a detent for locking therewith).

Further, depending on the type of detent 324 on the knitting peg 300, a through hole of each of the pin receiving openings 120 or 220 may be adapted to receive the detent 324 in different ways. For example, if detent 324 is provided in the form of a protrusion on a knitting peg 300, the through hole may be designed to have a corresponding indentation to receive the detent 324 therein. Alternatively, detent 324 may be designed to catch against an edge created by the intersection of through hole and the slot 150 or 250 on the bottom of the base structure. If detent 324 is an indentation, a through hole of each pin receiving opening 120 or 220 may have corresponding protrusions to jut into detent 324.

FIG. 8 illustrates an example knitting peg 300 inside an example base structure 110. Also illustrated is an example slot 150 into which the knitting peg 300 extends via pin receiving opening 120. Knitting peg 300 may have a peg length $P_L$ extending from a top of the peg to its bottom. The peg length $P_L$ may range, for example, between approximately one to approximately three inches, although other lengths are possible. A distance that the knitting peg 300 extends above or over the base structure 110 when it is inserted and into its loom may be described as a peg height $P_H$. The peg height $P_H$ can be measured from a top surface of the loom to the top of the peg. The peg height $P_H$ may be, for example, between approximately one to approximately two inches, although other heights are possible. The knitting peg may also have a peg depth $P_D$ in which a base of the knitting peg 300 extends into the base structure 110. In this illustration, the peg depth $P_D$ refers to a measurement along the knitting peg 300 extending from substantially between the top surface of the loom to the detent 324 (e.g., above the lock or detent). The peg depth may also refer to a measurement from the top surface of the loom to the bottom surface of the peg. Besides holding its respective knitting peg within a pin receiving opening, each of the detents 324 are configured to position the knitting pegs at a substantially similar peg height $P_H$ (because each of their detents 324 are positioned similarly on the body 320 and are secured at approximately a same peg depth $P_D$ relative to the loom 110). This allows the pegs to be inserted and aligned at a substantially similar height in base structures.

The knitting peg 300 may also have a peg diameter $P_D$. In accordance with an embodiment, the peg diameter $P_D$ may be between approximately 0.15 and approximately 0.50 inches, although other dimensions are possible. The pin receiving opening 120 and/or through hole 122 may have a complementary opening diameter to the diameter $P_D$ of the peg. Further, as described above, in accordance with an embodiment, both of the knitting peg 300 and the pin receiving opening 120 or through hole 122 may taper, leading to portions of knitting peg 300 having different diameters along its length, as well as portions of pin receiving opening 120 having different diameters (e.g., from the top surface of the loom to its intersection with slot 150). In another embodiment, the body 320 of each respective knitting peg is tapered to prevent passage of the knitting peg through a pin receiving opening. In yet another embodiment, the diameter of the body 320 of knitting peg 300 may taper, or the diameter of at least part of pin receiving opening 120 (or through hole 122) may taper, or both.

In an embodiment, as shown in FIG. 8, the peg diameter $P_D$ is a measurement of the diameter along a bottom 322 of the peg 300. The diameter $D_S$ of the slot 150 can be slightly greater than the diameter $P_D$ at the bottom 322 of the peg 300, accommodating for the receipt of detent therein. For example, the difference between the peg diameter $P_D$ and the slot diameter $D_S$ may be approximately equal to or less than the distance DL that the detent extends from the body 320.

Further, the measurement of a diameter from one side to another side using the locks or detents may have a lock diameter that differs from the peg diameter at its bottom. As described above, depending on whether the lock or detent is a protrusion or an indentation, the diameter of the knitting peg 300 at the lock or detent may be slightly greater or slightly smaller than the peg diameter $P_D$ at its bottom. For example, if the lock or detent is a protrusion, the lock diameter may be, for example between approximately 0.001 and approximately 0.010 inches greater than the diameter of an adjacent portion of the knitting peg 300 (e.g., at its bottom, or PD as shown in FIG. 8).

As previously noted, FIGS. 10 and 11 illustrate an alternate embodiment of a knitting peg 401 having a locking detent 424 that extends substantially around the circumference of a its body 420 at or adjacent its bottom. Knitting peg 401 is another example of a detail of the knitting pegs 130 that can be used in the looms 100 and 200 described above. Knitting peg 401 includes a head 410, a body 420, and a bottom portion 422. At least some of the features described above with regards to knitting peg 300 may also be provided on knitting peg 401, and therefore not all features, dimensions, or details are repeated here, but should be understood that the features, dimensions, and/or details described above with respect to knitting peg 300 in FIGS. 6-8 may also be features, dimensions, and/or details of knitting peg 401 in FIGS. 10-11. For example, the head 410 may have a portion that is wider than a portion of the body 420 to deter yarn from unintentionally slipping over the head 410. The head 410 may also include a notch 412 to catch yarn slipping upwards along the knitting peg 401. Knitting peg 401 has a peg length $P_L$ extending from a top of the peg to its bottom and is configured to extend a distance above or over the base structure 110 when it is inserted and into a loom. The knitting peg may also have a peg depth $P_D$ in which a base of the knitting peg 401 extends into the base structure 110 and a peg diameter $P_D$.

The body 420 includes a groove 426, which can be similar to groove 326 in that it may facilitate aligning of the knitting peg 401 for placement into a pin receiving opening 120. The surfaces of the groove may be rounded so that sharp edges along the pin are removed. For example, as shown in FIG. 10, a front edge below the head 410 may be formed at an angle $\alpha$ relative to the groove 426 so that yarn can easily slide into the notch 412 under the head. In one embodiment, the angle $\alpha$ is between and/or including approximately ten degrees to approximately fifteen degrees. In another embodiment, the angle $\alpha$ is approximately twelve degrees. Also, as another example, as shown in FIG. 11, as the groove 426 curves downwardly (from either side) from the head 410 towards the bottom 422 along the length of the body 420, the edges may be formed with a radius R. Although only shown on a first (right) side, both sides can be formed with a radius R. In an embodiment, the edge has a radius R of approximately 0.040.

Knitting peg 401 also includes a detent 424 adjacent a bottom portion 422 of body 420. Detent 424 may be configured to hold knitting peg 401 within a pin receiving opening on a base structure (e.g., pin receiving opening 120 on base structure 110). In one example, knitting peg 401 may snap fit into a pin receiving opening via detent 424. Detent 424 can hold its respective knitting peg 401 within pin receiving opening 120 (or through hole 122) via passage through pin receiving opening 120 and into slot 150. Any portion of base structure 100 may be adapted to receive or lock with detent 424. A detent 424 may be designed to substantially and/or completely prevent removal of a knitting peg 401 without snapping the knitting peg 401. In another embodiment, the detent 424 would simply deter removal of the knitting peg 401 while still allowing the knitting peg 401 to be removable.

As seen in the drawings, the detent can extend substantially around the base of the body 420. It may extend from one side of the groove 326 around to the other side of the groove in the form of a protrusion. The protrusion may extend from the entire circumference of the body 420 of the knitting peg 401 except for where the groove 426 is located. The protrusion may, for example, extend a distance $D_L$ from an edge of the body 420 of the knitting peg 401 (see FIG. 11). In an embodiment, the detent 424 is a substantially rounded extension comprising a radius R2 (see FIG. 11). The radius of the detent may be approximately 0.030, for example.

Additionally, instead of a protrusion, in accordance with another embodiment, detent 424 may be provided in the form of one or more indentations on the body 420 of the knitting peg 401 (with through hole 122 having a detent for locking therewith).

Besides holding its respective knitting peg within a pin receiving opening, each detent 424 is configured to position the knitting peg at a substantially similar peg height $P_H$ (because each of their detents 424 are positioned similarly on the body 420 and thus secured at approximately a same peg depth $P_D$ relative to the loom 110). This allows the pegs to be inserted and aligned at a substantially similar height in base structures.

The pin receiving opening 120 and/or through hole 122 may have a complementary opening diameter to the diameter $P_D$ of the peg 401. Further, as described above, in accordance with an embodiment, both of the knitting peg 401 and the pin receiving opening 120 or through hole 122 may taper, leading to portions of knitting peg 401 having different diameters along its length, as well as portions of pin receiving opening 120 having different diameters (e.g., from the top surface of the loom to its intersection with slot 150). In another embodiment, the body 420 of each respective knitting peg is tapered to prevent passage of the knitting peg through a pin receiving opening. In yet another embodiment, the diameter of the body 420 of knitting peg 300 may taper, or the diameter of at least part of pin receiving opening 120 (or through hole 122) may taper, or both.

Knitting pegs with detents may help prevent the knitting pegs from falling out of the knitting loom. For example, detents can help secure the bodies of the pegs within the slot or through hole. This may prevent an accidental jolt to the knitting peg by the person working the loom from removing the knitting peg from its pin receiving opening, for example. Further, knitting pegs with detents may also be useful for some knitting methods that are easier to operate when tilting and/or flipping the knitting loom. Further, when storing or traveling with the knitting loom, the knitting pegs may be less likely to fall out when secured using the detent as disclosed herein.

The examples discussed herein provide that a single handloom may perform single knit, double knit and circular knit, for example. The loom may be a non-circular knitting loom that is shaped, not exclusively, as square, oblong, elliptical, and/or rectangular. Knitting looms may also be formed in custom shapes or sizes. In another embodiment, the loom may also be a substantially circular, round, or oval loom. The substantially non-circular base structure of the loom may include, but is not limited to, the following shapes: an ellipse, an oblong, a rectangle, a rounded rectangle or an oval. If pegs are placed equidistant around a circular shape or, if a long narrow loom also has pegs on its ends, the looms can be used for both flat and circular knitting.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A knitting loom comprising:

a base structure having a plurality of pin receiving openings, each pin receiving opening comprising a through hole with a shape configured to receive a knitting peg therein, and a plurality of knitting pegs received in the pin receiving openings, each knitting peg comprising a body having a shape complimentary to the shape of the pin receiving openings and positioned within the pin receiving openings such that the knitting pegs extend perpendicularly away from the base structure, and each knitting peg comprising a bottom portion that is accessible through a bottom of the base structure such that a user can eject the knitting peg from its pin receiving opening, and wherein each knitting peg further comprises a detent adjacent the bottom portion of its body, the detent configured to hold its respective knitting peg within its pin receiving opening.

2. The knitting loom according to claim 1, further comprising a slot defined by the bottom of the base structure, the slot connecting at least two adjacent pin receiving openings.

3. The knitting loom according to claim 2, wherein the base structure is substantially circular, and wherein the slot runs substantially entirely along the bottom of the base structure.

4. The knitting loom according to claim 2, wherein the base structure comprises two substantially parallel parts, each parts having its own separate slot.

5. The knitting loom according to claim 2, wherein the base structure comprises two detachable substantially semi-circular portions, each portion having its own separate slot.

6. The knitting loom according to claim 1, wherein each of the plurality of knitting pegs are snap fit into the pin receiving openings via at least the detent.

7. The knitting loom according to claim 6, wherein each of the plurality of knitting pegs are configured to be snap fit into the pin receiving opening via passage through the pin receiving opening and into the slot.

8. The knitting loom according to claim 1, further comprising a tool shaped to fit within the pin receiving openings, and wherein the tool is operable to at least eject the plurality of knitting pegs from their pin receiving openings.

9. A knitting loom comprising:

a base structure having a plurality of pin receiving openings, each pin receiving opening comprising a shape configured to receive a knitting peg therein, and a plurality of knitting pegs received in the pin receiving openings, each knitting peg comprising a body having a shape complimentary to the shape of the pin receiving openings and positioned within the pin receiving openings such that the knitting pegs extend perpendicularly away from the base structure, and each knitting peg comprising a body with a detent adjacent a bottom portion of the body, the detent configured to hold its respective knitting peg within the pin receiving opening, and wherein the bottom portion of each of the plurality of knitting pegs is accessible through a bottom of the base structure such that a user can eject each of the plurality knitting pegs from their respective pin receiving openings.

10. The knitting loom according to claim 9, wherein the plurality of knitting pegs are snap fit into the pin receiving openings via the detents.

11. The knitting loom according to claim 9, further comprising a slot defined by the bottom of the base member, the slot connecting at least two adjacent pin receiving openings.

12. The knitting loom according to claim 11, wherein the detent holds its respective knitting peg within the pin receiving opening via passage through the pin receiving opening and into the slot.

13. The knitting loom according to claim 9, wherein the detent holds its respective knitting peg within the pin receiving opening via passage into a portion of the base structure adapted to receive the detent.

14. The knitting loom according to claim 9, wherein the body of each respective knitting peg is tapered to prevent passage of the knitting peg through the pin receiving opening.

* * * * *